US008434931B2

(12) United States Patent
Beigzadeh et al.

(10) Patent No.: US 8,434,931 B2
(45) Date of Patent: May 7, 2013

(54) STIRRER AND APPARATUS FOR SMALL VOLUME MIXING

(75) Inventors: Daryoosh Beigzadeh, Midland, MI (US); Victor A. Atiemo-Obeng, Midland, MI (US); Laura J. Dietsche, Midland, MI (US); David R. Neithamer, Midland, MI (US)

(73) Assignee: Dow Global Technologies LLC

( * ) Notice: Subject to any disclaimer, the term of this patent is extended or adjusted under 35 U.S.C. 154(b) by 1031 days.

(21) Appl. No.: 12/114,323

(22) Filed: May 2, 2008

(65) Prior Publication Data

US 2008/0298170 A1 Dec. 4, 2008

Related U.S. Application Data

(60) Provisional application No. 60/932,129, filed on May 29, 2007.

(51) Int. Cl.
*H01F 7/00* (2006.01)

(52) U.S. Cl.
USPC ..... 366/297; 366/328.4; 366/325.94; 366/316

(58) Field of Classification Search ..... 366/293, 366/295, 328.1, 328.2, 328.4, 325.91, 325.93, 366/325.94
See application file for complete search history.

(56) References Cited

U.S. PATENT DOCUMENTS

| | | | | | |
|---|---|---|---|---|---|
| 216,780 | A | * | 6/1879 | Churn | 74/89.18 |
| 941,948 | A | * | 11/1909 | Dress | 366/327.3 |
| 1,573,760 | A | * | 2/1926 | Black | 366/249 |
| 1,841,434 | A | * | 1/1932 | Gibson | 366/129 |
| 2,046,784 | A | * | 7/1936 | Krause | 219/209 |
| 2,572,375 | A | * | 10/1951 | Oertli | 366/315 |
| 3,030,083 | A | * | 4/1962 | Stiffler | 416/199 |
| 3,158,359 | A | * | 11/1964 | Stiffler | 416/231 R |
| 3,697,053 | A | * | 10/1972 | Will | 366/343 |
| 4,004,786 | A | * | 1/1977 | Stephens | 366/330.7 |
| 4,083,653 | A | * | 4/1978 | Stiffler | 416/142 |
| 4,176,979 | A | * | 12/1979 | Saida | 401/100 |
| 4,339,992 | A | * | 7/1982 | Kurland | 99/348 |
| 4,936,688 | A | * | 6/1990 | Cornell | 366/146 |
| 5,102,229 | A | | 4/1992 | Wada et al. | |
| 5,199,788 | A | * | 4/1993 | Stallings | 366/247 |

(Continued)

FOREIGN PATENT DOCUMENTS

| | | |
|---|---|---|
| GB | 1450517 | 9/1976 |
| JP | 08-252445 | 10/1996 |

(Continued)

*Primary Examiner* — Joseph S Del Sole
*Assistant Examiner* — Nahida Sultana

(57) ABSTRACT

This invention is a stirrer, impeller or stirrer paddle used for mixing small volumes of liquid in a vessel having a small capacity for liquid, said impeller being characterized by an impeller blade connected to the bottom portion of a support, where the blade has an opening extending through the blade from the front to the back surface of the blade said opening extending across the rotational axis of the impeller. The invention is also an apparatus comprising that blade, a method of mixing components using the apparatus and an array of two or more of the apparatuses.

19 Claims, 9 Drawing Sheets

U.S. PATENT DOCUMENTS

| | | | | |
|---|---|---|---|---|
| 5,297,938 | A * | 3/1994 | Von Essen et al. | 416/237 |
| 5,664,883 | A * | 9/1997 | Tomassini | 366/325.93 |
| 6,121,379 | A | 9/2000 | Yamanaka et al. | |
| 6,582,116 | B2 | 6/2003 | Nielsen | |
| 6,616,318 | B1 * | 9/2003 | LeBlanc et al. | 366/129 |
| 6,834,990 | B2 | 12/2004 | Nielsen | |
| 6,893,499 | B2 | 5/2005 | Fusegawa et al. | |
| 6,994,827 | B2 | 2/2006 | Safir et al. | |
| 2003/0169638 | A1 | 9/2003 | Nielsen | |
| 2010/0177593 | A1 * | 7/2010 | Takenaka | 366/293 |
| 2010/0214868 | A1 * | 8/2010 | Takenaka et al. | 366/316 |

FOREIGN PATENT DOCUMENTS

| | | |
|---|---|---|
| JP | 08-281089 | 10/1996 |
| JP | 3586685 B2 | 8/2004 |
| WO | WO 01/93998 | 12/2001 |
| WO | WO 03/026790 | 4/2003 |

* cited by examiner

STIRRER AND APPARATUS FOR SMALL VOLUME MIXING

CROSS-REFERENCES TO RELATED APPLICATIONS

This is a 35 U.S.C. §111(a) application claiming benefit of U.S. Provisional Patent Application No. 60/932,129 filed May 29, 2007. The entire contents of U.S. 60/932,129 is incorporated herein by reference.

FIELD OF THE INVENTION

This invention relates to a stirrer design and apparatus for mixing small volumes of liquid with other liquids, solids or gases, and in particular impellers used to provide the mixing of fluids in parallel processing reactor apparatus for conducting high throughput research.

BACKGROUND OF THE INVENTION

Very small scale reactors and mixers and the like are becoming an important part of the research methodology in materials development as these allow rapid assessment of various materials and chemistries. Symyx Discovery Tools Inc. provides some such tools including a parallel pressure reactor. Applicants have found that existing impellers such as described in U.S. Pat. No. 6,834,990 while providing mixing are not necessarily adequate in many circumstances in these very small reaction chambers. Thus, the need for an improved impeller or stirrer and an apparatus was needed.

Mixing equipment (including impellers) is advantageously tailored in certain circumstances to the process objectives desired for the process under study. Thus a significant variety of impeller designs exist to be used for mixing relatively larger volumes than what pertain in parallel processing high throughput equipment. Such impellers are described in numerous publications by vendors such as Caframo Ltd, IKA Works, and INDCO Mixing equipment. Other mixing elements such as loop stirrers (see e.g., Great Britain Patent Number GB 1450517) are also known. Often the mixing elements are taught to require baffles or other complex geometries in the mixing chamber (see e.g., U.S. Pat. No. 5,102,229; Japanese Patent Application Publication Number JP 08-252445, also known as JP 1996-252445; or Japanese Patent Number 3586685 B2 (family to JP 08281089, also known as JP 1996-281089). Such complex geometries are not well suited to small volume mixers.

SUMMARY OF THE INVENTION

The present invention has been undertaken to overcome observed deficiencies in mixing very small volumes of materials. In its various embodiments, the present invention provides one or more of the following: an impeller that is more effective in providing mixing of small volumes of fluids in a vessel of small capacity such as used in high throughput parallel processing reactors; an impeller with geometric features selected to enhance drawdown and mixing of gases from the headspace into the liquid; an impeller with geometric features selected to achieve more rapid mixing within the liquid; an impeller with geometric features selected to prevent compartmentalization of unmixed zones of liquid; an impeller with geometric features selected to prevent deposition of viscous liquid or solids on the side or bottom wall portions of the vessel; an impeller with a relatively simple structure that can be molded as a single element.

Thus, according to a first embodiment, this invention is a stirrer, impeller or stirrer paddle used for mixing small volumes of liquid in a vessel having a small capacity for liquid such as used in parallel processing reactor apparatus for conducting high throughput research, said impeller being characterized by a rotational axis, said impeller comprising a support having a top portion which is suitable for connecting to a driver to cause rotation of the impeller and a bottom portion, and an impeller blade connected to the bottom portion of the support, the blade has front and back primary surfaces which define a thickness of the blade, top and bottom edges which define a length of the impeller blade and two side edges which define a width of the impeller blade, the top, bottom and side edges together defining an area of each of the primary surfaces of the impeller blade, the impeller blade being connected to the shaft on at least the top edge, the blade has an opening defined by top, bottom and side interior edges of the blade extending through the blade from the front to the back surface said opening extending across the rotational axis of the impeller, wherein the opening comprises no more than 60 percent (%) of the area of the primary surface of the impeller blade.

According to a second embodiment, this invention is an apparatus comprising a mixing container having a capacity of less than about 50 milliliters (mL), the impeller as stated above extending into the container and a drive means to cause rotation of the impeller around the longitudinal axis.

According to a third embodiment, this invention is a method of mixing a liquid with one or more other liquids, gasses and/or solids using such an apparatus. Preferably, the liquid is mixed with a second liquid, a gas or a solid.

According to a fourth embodiment, this invention is a parallel mixing device comprising two or more of the apparatuses of this invention in an array.

DETAILED DESCRIPTION OF THE INVENTION

Figure 1:
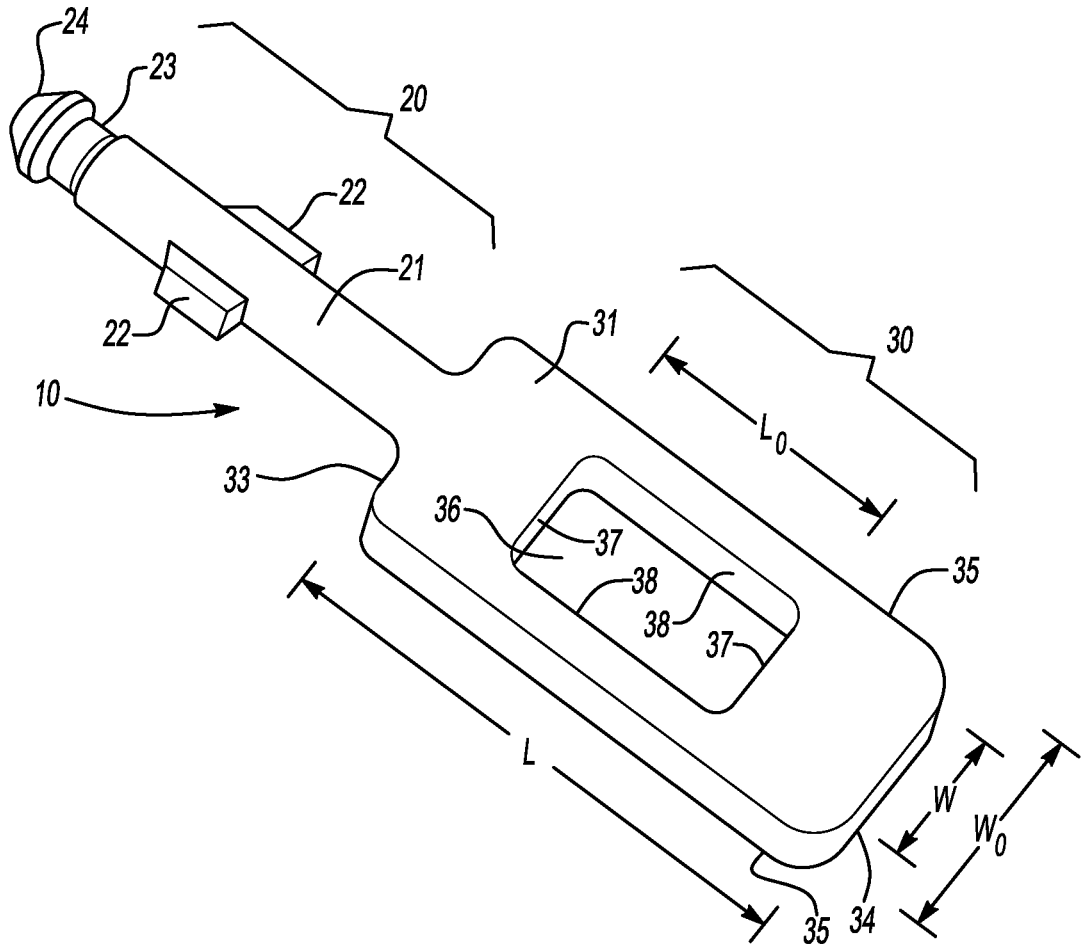
FIG. 1 is a drawing of one example of an impeller of this invention.

The impeller of this invention can be further described in reference to FIG. 1 which shows an example of an impeller within the scope of this invention. The impeller 10 comprises a support 20 and a blade 30. In the embodiment shown the support 20 comprises a shaft 21 that is coaxial with the rotational axis of the impeller. On the shaft 21 are optional nubs 22 that are used in rotating the impeller. The support 20 may be connected to a drive element a groove 23 and conical end 24 which enables releasable engagement with a coupling device of a driver for the impeller.

Attached at the end of the support 20 is the blade 30. The blade 30 has a top surface 31 and a bottom surface on the opposite side as primary surfaces on the blade 30. The length of the blade, L, is defined by top exterior edge 33 and bottom exterior edge 34. The width of the blade W is defined by exterior edges 35. The thickness of the blade is preferably substantially constant throughout the blade. The blade is characterized by the presence of the opening 36 defined by top and bottom interior edges 37 and interior side edges 38. The dimensions of the opening can be called $W_O$ and $L_O$.

While the support shown in FIG. 1 is a shaft coaxial with the rotational axis of the impeller other supports could be used such as a "y-shaped" support, two support arms extending from the drive mechanism and the like.

While the blade shown is somewhat rectangular in shape other shapes such as oval or semicircular may be used depending upon the shape of the mixing container in which the impeller is to be used. Similarly, while the opening shown is substantially rectangular, other shapes such as triangular, circular, oval, square and the like may be used provided the opening extends across the rotational axis of the impeller. The opening need not be symmetric. In addition, if the opening dimensions become very large, vertical, horizontal or diagonal support struts may be used across the opening to provide enhanced mechanical strength to the impeller blade. Preferably, the opening comprises at least 15%, more preferably at least 20% of the area defined by the outside edges of the blade. Preferably the opening comprises no more than 50%, more preferably no more than 45%, more preferably still less than 40% and most preferably less than 30% of the area defined by the outside edges of the blade.

Without wishing to be bound by theory, the opening in the blade is believed by the inventors to promote and enhance axial flow and mixing in the device.

For a preferred impeller structure which is substantially rectangular or rectangular with a rounded bottom edge, the length of the opening, $L_O$, is preferably at least 25%, more preferably at least 30% of the length of the blade, L, and preferably less than 60%, more preferably less than 55% of the length of the blade, L. The width of the opening, $W_O$, is preferably at least 40%, more preferably at least 50% of the width, W, of the blade and is preferably less than 80%, more preferably less than 75% of the width W of the blade.

The portion of the blade from the bottom interior edge to the bottom edge is preferably at least 15%, more preferably at least 20% of the length of the blade and is preferably no more than about 50%, preferably no more than 45% of the length of the blade. The portion of the blade from the top interior edge to the top edge preferably is at least 5%, more preferably at least 10% of the length of the blade and preferably no more than 40% more preferably no more than 30% the length of the blade. The blade dimensions will vary proportional to the dimensions of the mixing container. However, preferably the blade length, L, is at least 1 centimeter (cm), more preferably at least 2 cm, most preferably at least 2.5 cm and preferably not more than 5 cm, more preferably not more than 4 cm, and most preferably not more than 3.5 cm. The blade width is preferably at least 0.5 cm and more preferably at least 1 cm but preferably not more than 2.5 cm, more preferably not more than 2 cm and most preferably not more than 1.5 cm. The blade thickness is preferably at least 0.5 millimeter (mm), more preferably at least 0.7 mm and preferably not more than 2 mm, more preferably not more than 1.5 mm.

The blade is to be made of a rigid material that is inert to the materials to be mixed. The blade may be metal or ceramic but preferably a heat resistant polymer. Impellers made of such polymeric materials can be easily molded for mass manufacture. When the impellers are made of polymers the material may advantageously include fillers such as glass or other known filler materials. Polyether ether ketone (PEEK) is a preferred material for the impeller. Preferably, the support is integral with the blade. The impeller that has a support integral with the blade can advantageously be manufactured by molding in a single piece the support and the blade.

Figure 2:
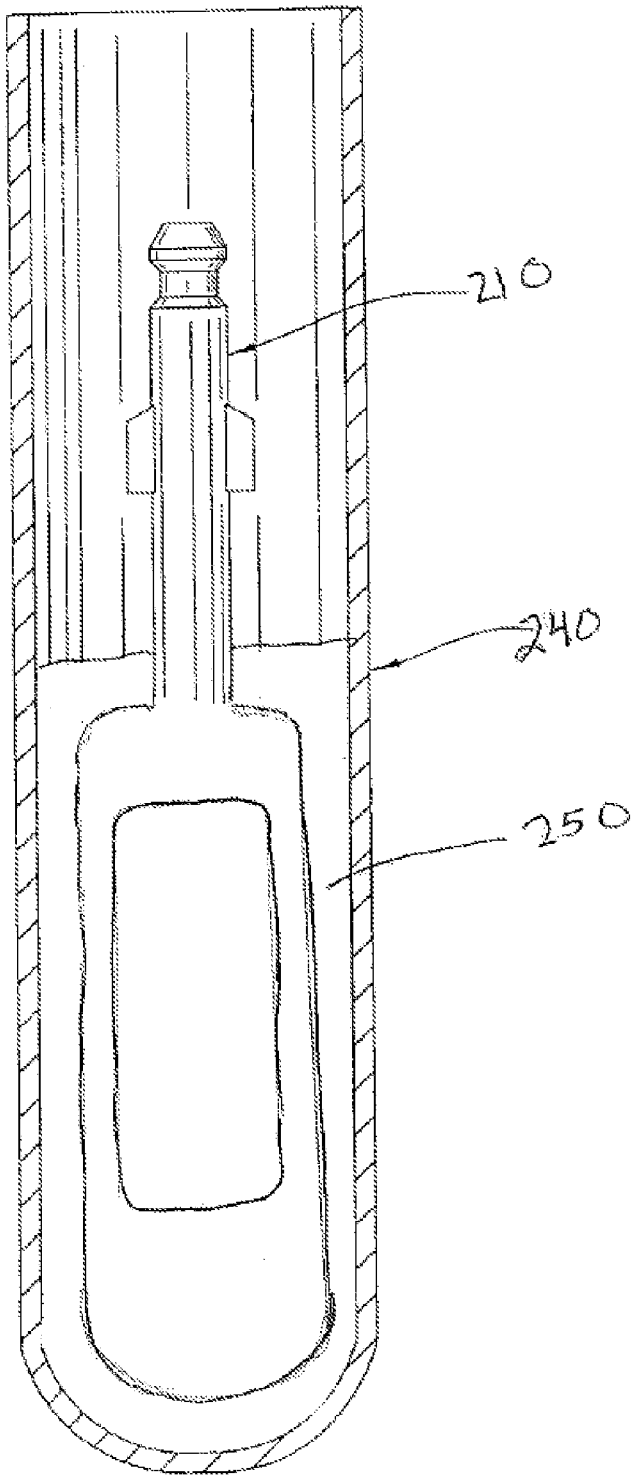
FIG. 2 is a drawing of one example of an impeller of this invention in a mixing container.

The geometry of the mixing container and its size and proportions relative to the size of the stirrer or impeller may impact the nature and effectiveness of the mixing. According to one preferred embodiment the mixing container is a cylindrical vial with a capacity of up to 50 mL, preferably up to 20 mL. Preferably the container comprises no baffles or the like. The height to inside diameter ratio of the vial is preferably less than 5, more preferably less than 2, but preferably more than 0.5 and more preferably more than 1. The impeller width, W, is preferably at least 50%, more preferably at least 60% and preferably less than 95%, more preferably less than 90% of the inside diameter of the container. Thus, FIG. 2 shows an example of an impeller 210 inside the container 240 filled with a fluid 250 that is to be mixed.

Figure 3:
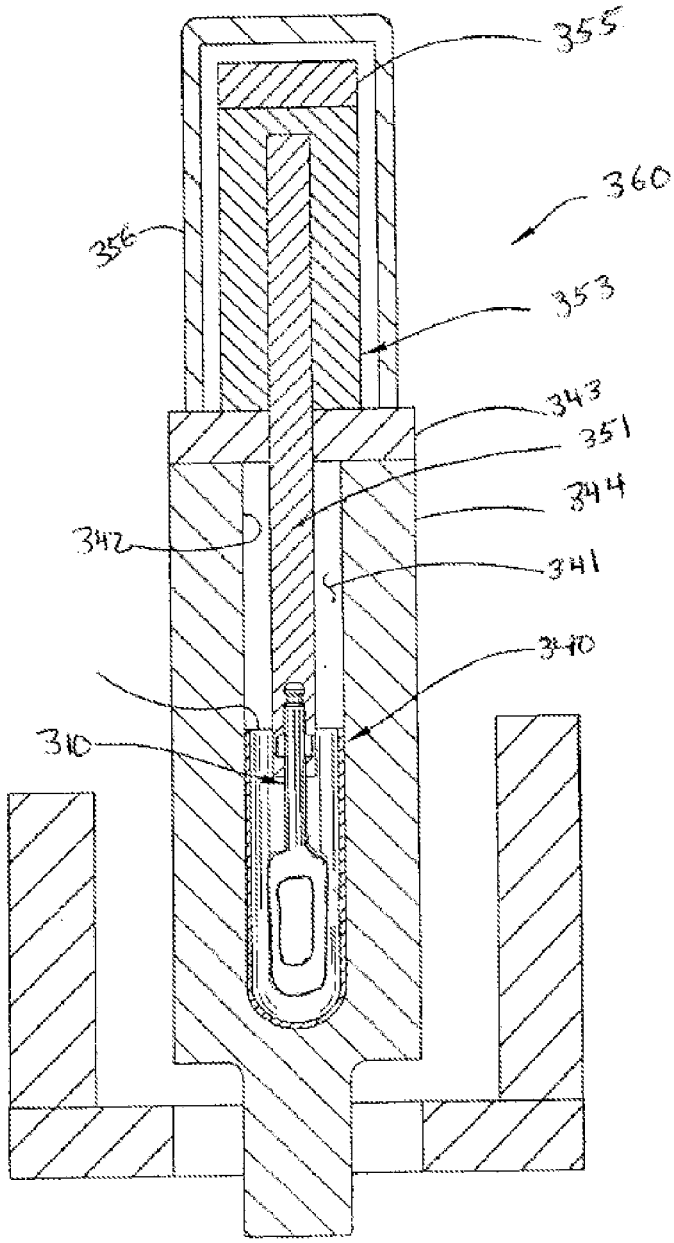
FIG. 3 is a drawing of one example of an apparatus of this invention.

Referring to FIG. 3 which shows an example of an apparatus 360 of this invention, one can see the impeller 310 in the mixing container 340 which is placed in a well 342 forming a headspace 341 above the mixing container. If desired, the mixing container could come up to the top or near the top of the well. The apparatus 360 is sealed with a header plate 343 which is releasably attached to the mixing chamber block 344. A header plate with ports for addition of materials may be desirably used although this is not shown. In this embodiment, a coupler 351 is attached to the impeller 310 and is magnetically coupled 353 to a gear train 355 driven by a motor (not shown) to rotate the impeller 310. A cover 356 is releasably attached to the header plate 343. This apparatus is just one example of the apparatuses of this invention. Other container shapes may be used and other known means of driving the impeller may be used.

The impeller is preferably rotated at speeds of up to 1000 rotations per minute (rpm) to 5000 rpm, and preferably at speeds in the range of 300 rpm-1200 rpm.

Desirably the materials to be mixed cover the top of the blade; however, mixing will occur provided at least a significant portion of the blade is immersed in the materials. The apparatus is suitable for mixing small quantities of liquids, preferably up to 50 mL, more preferably up to 40 mL, more preferably still up to 30 mL, more preferably yet up to 20 mL, and most preferably up to 10 mL.

This impeller and apparatus system are effective in mixing liquids in the container, and preferably are used to enhance drawdown of gasses in the headspace above the liquid into the liquid for dissolution and if desired subsequent reaction. However, the impeller and apparatus may also be used to mix solids into liquids or mix other components as desired.

The apparatus is beneficially used in an array with other similar apparatuses. A preferred example of such an array is shown in U.S. Pat. No. 6,994,827, incorporated herein by reference.

EXAMPLES

The impellers evaluated in the Examples described below and shown in FIG. 4 includes the prior art impeller of U.S. Pat. No. 6,834,990 and five examples of the impellers of this invention.

Example 1

In this experiment, saturation of a solution of a linear low-density polyethylene (LLDPE) sample in Isopar-E with propylene was studied. This polymer solution has a significantly higher viscosity than pure ISOPAR™ E (Exxon Mobil Corporation), which makes the experimental conditions resemble actual polymerization experiments in parallel reactors such as those taught in U.S. Pat. No. 6,994,827. The general apparatus used was a Parallel Pressure Reactor, PPR®, made by Symyx Discovery Tools Inc. According to the general procedure, glass tubes are preloaded with dry polymer before being placed in the reactors. Appropriate amounts of solvent are added to obtain the desired concentration, using the robotic syringes. The reactors are then heated to the desired temperature and then pressurized with ethylene or propylene to obtain a constant pressure. The uptake of gas versus time is monitored and recorded in order to study the dissolution phenomenon, as described below. The rate of saturation (mass transfer) is strongly dependent on the efficiency of the gas-liquid mixing. The impeller speed in these experiments is set at 800 rpm.

The saturation phenomenon was studied using a mass transfer model. The model is based on the fact that the rate of transfer of gaseous monomer from the headspace into the liquid phase is proportional to the difference between the concentration of monomer in liquid at saturation and its concentration in the liquid at anytime, during the experiment. The model has the following general form:

$$\frac{d[M]_l}{dt} = A \cdot k_a \cdot ([M]_s - [M]_l) \quad (1)$$

where:

$$\frac{d[M]_l}{dt}$$

is the rate of dissolution of gas from the headspace into the liquid (mass transfer rate) per unit volume of the liquid phase, $[M]_l$ is the concentration of monomer in the liquid phase, $[M]_s$ is the concentration of monomer in liquid at saturation, A is the mass transfer surface area per volume of liquid, and $k_a$ is the mass transfer coefficient. Integration of Equation 1 results in the total uptake-time relationship:

$$\text{Uptake}(t) = V_l \cdot [M]_s (1 - \exp(-k_a \cdot A \cdot t)) \quad (2)$$

where $V_l$ is the liquid phase volume. Since $k_a$ is a constant, then the apparent mass transfer coefficient, $k_a^* = k_a \times A$, is a good indication of mass transfer area, or in other words the efficiency of the mixing.

Figure 4:
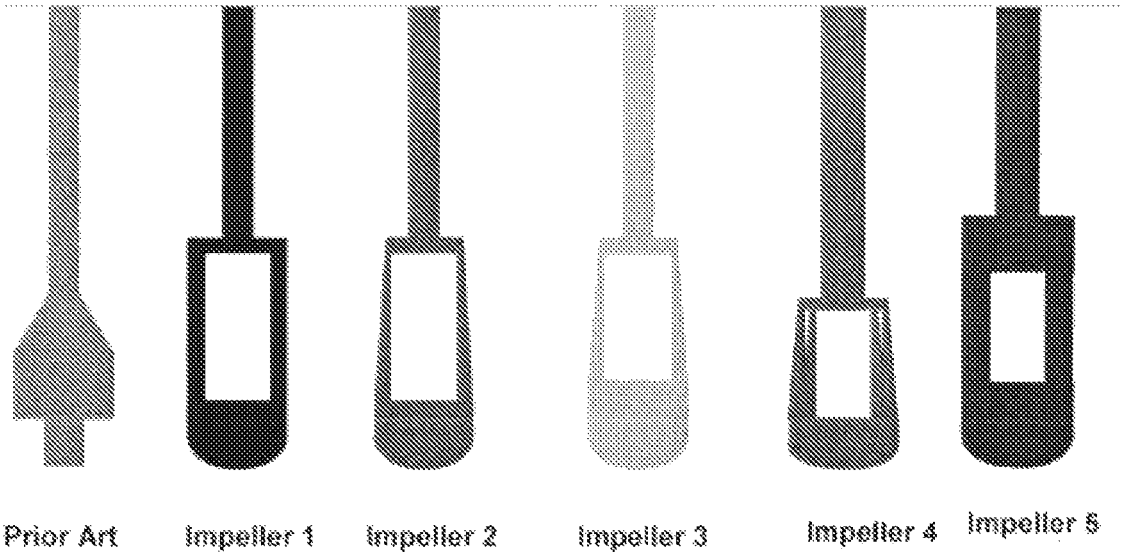
FIG. 4 shows the front view of the prior art impeller and five different exemplary impellers of this invention.
Figure 5A:
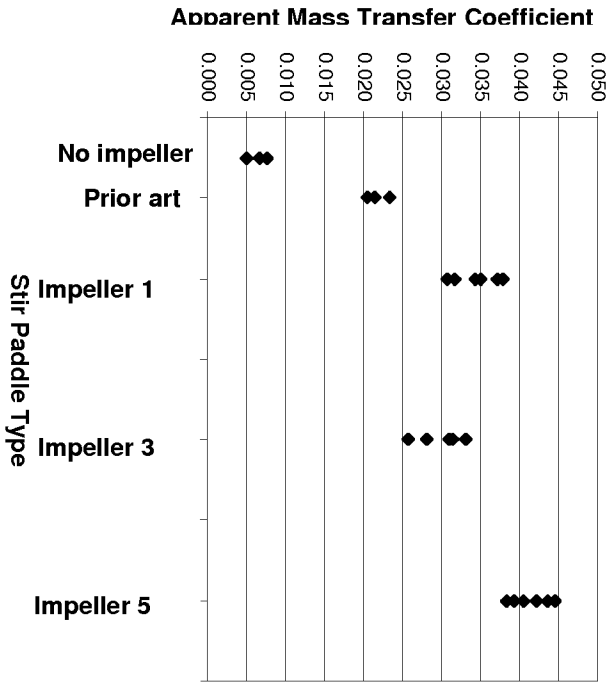
FIGS. 5*a*, 5*b*, and 5*c* show apparent mass transfer coefficient for gases into polymer solution without using an impeller, using the prior art impeller and using impellers of this invention.
Figure 5B:
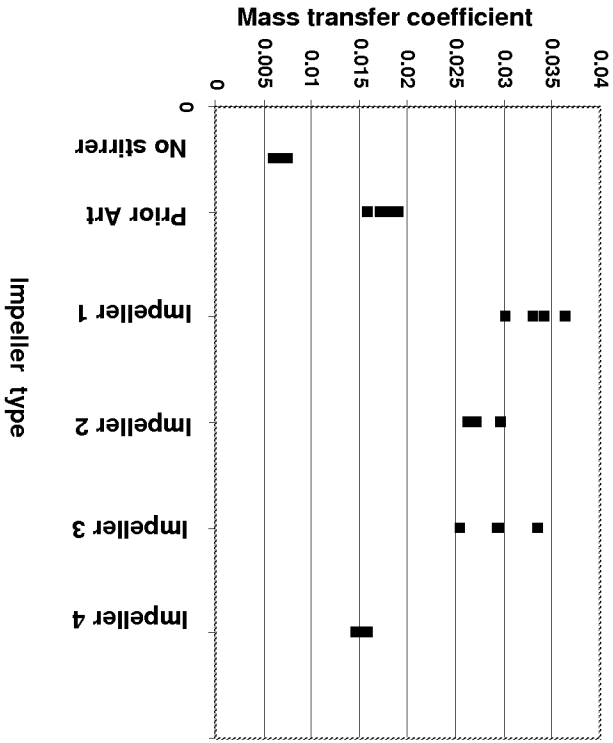
Figure 5C:
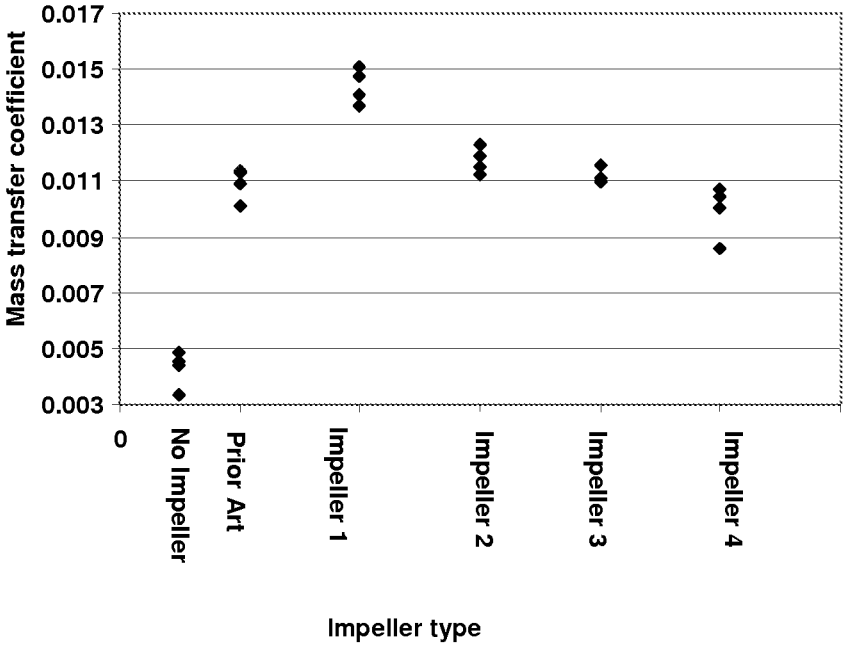

Using the uptake-time data obtained from the saturation experiment which is performed substantially as set forth above, $[M]_s$ and $k_a^*$ can be estimated and the apparent mass transfer coefficient is shown in FIGS. 5*a* and 5*b* for the impellers of FIG. 4 and compared with the case without any rotating impeller. FIGS. 5*a* and 5*b* show apparent mass transfer coefficient for propylene in a solution of about 150 mg of LLDPE in about 4.5 mL of ISOPAR™ E (FIG. 5*b* was at about 130° C.). FIG. 5*c* shows apparent mass transfer coefficient for propylene in a solution of about 200 mg of LLDPE in about 6.5 mL of ISOPAR™ E at about 130° C.

Example 2

Figure 6:
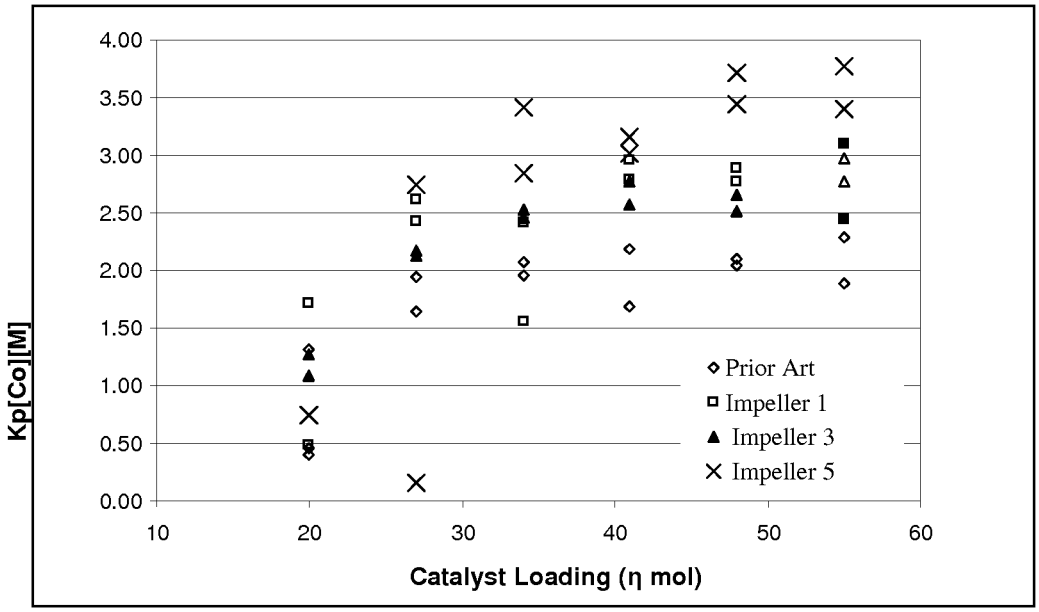
FIG. 6 illustrates effectiveness of impellers as shown by polymerization reaction rates.

Using the Symyx PPR® system, the copolymerization of ethylene/1-octene is used to evaluate the efficiency of gas-liquid mixing. The polymerization is catalyzed with titanium (N-1,1-dimethylethyl)dimethyl(1-(1,2,3,4,5-η)-2,3,4,5-tetramethyl-2,4-cyclopentadiene-1-yl) silanaminato))(2-)N)-dimethyl. The polymerization catalyst is activated with Armeenium tetrakis(pentafluorophenyl)borate and MMAO (modified methyl alumoxane) was used as scavenger. Polymerization experiments are carried out at 130° C. and 200 pound-force per square inch gauge (psig). Typically, the rate of polymerization is directly proportional to the catalyst concentration. However, for polymerization to occur, ethylene must first transfer from the headspace gas into the liquid phase, where the polymerization is carried out. By increasing the catalyst loading the polymerization rate can become comparable to or even faster than the rate of mass transfer. Under this condition, the observed rate of ethylene consumption approaches the rate of ethylene transfer to the liquid phase regardless of any catalyst loading increase. FIG. 6 shows the comparison for the various impellers of FIG. 4 and shows that reaction rate for reactions run substantially as set forth above is higher indicating more effective mass transfer for the impellers of this invention than for the prior art impeller.

Figure 7:
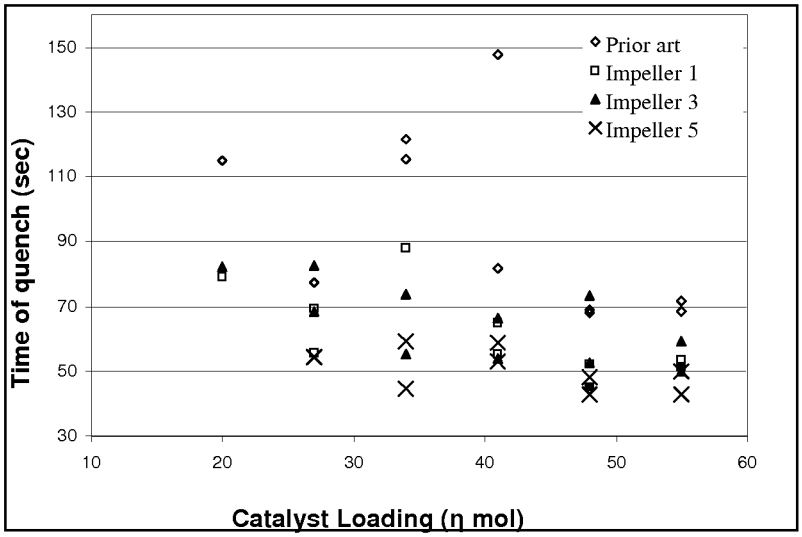
FIGS. 7 and 8 respectively illustrate effectiveness of impellers as shown by time of quench of polymerization reaction based on the pressure drop after introduction of quench gas using prior art impeller and impellers of this invention.

Similarly, the time of quench or cessation of the polymerization reaction from time of introduction of quench gas is much shorter for the impellers of this invention than for the prior art impeller indicating that the impellers of this invention are more effective in assisting the mass transfer of the quench gas from the headspace into the reaction solution, and the dissolution of the quench gas in the reaction solution. (See FIG. 7)

Example 3

Figure 8:
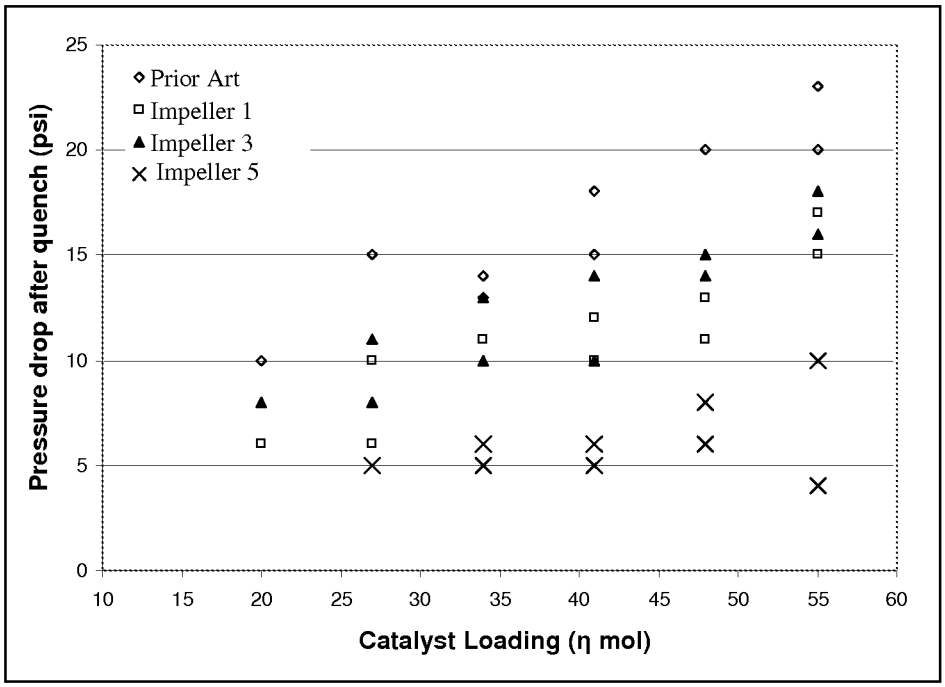

In most polymerization experiments carried out in the PPR®, the reaction is quenched at some point by the introduction of about 40 pounds per square inch (psi) of a gaseous catalyst poison. Since the polymerization catalyst resides only in the liquid phase, the efficiency of the quench is strongly dependent on the rate at which the quench gas transfers from the headspace and mixes into the liquid phase. Although the gaseous monomer feed line is shut off just before the introduction of the quench gas, there will still exist a considerable amount of unreacted gaseous monomer in the reactor at the time of quench. Typically, the quench gas is introduced for about 30 seconds. If the quench is efficient, the catalyst will be mostly dead and polymerization will be stopped. However, if the quench is inefficient, active catalyst will continue polymerizing the remainder of the gaseous monomer in the reactor. This results in a pressure drop in the reactor due to the conversion of the gaseous monomer into polymer. Therefore, the pressure drop after the quench can be used as a measurement of the efficiency of the quench, i.e. the efficiency of mixing. As shown in FIG. 8, the impellers of this invention are more effective at dispersing the quench gas in the solution as indicated by pressure drop after introduction of the quench gas.

What is claimed is:

1. An impeller used for mixing a gas or mixture of gases into a liquid, wherein the liquid is in a vessel having a capacity of less than about 50 milliliters, wherein a gas or mixture of gases is introduced into said vessel above said liquid and the gas is mixed into said liquid by the impeller, said impeller being characterized by a longitudinal axis around which the impeller rotates and said impeller comprising a support shaft having a top portion which is suitable for connecting to a driver to cause rotation of the impeller and a bottom portion, and an impeller blade connected to the bottom portion of the support shaft, wherein the blade has front and back primary surfaces which define a thickness of the blade, top and bottom exterior edges which define a length of the impeller blade and two side exterior edges which define a width of the impeller blade the top, bottom and side edges together defining an area of said primary surface of the impeller blade, the top exterior edge of said impeller blade being connected to the bottom portion of said shaft the blade has an opening defined by top, bottom and side interior edges of the blade extending through the blade from the front to the back surface said opening extending across the rotational axis of the impeller, wherein the opening comprises no more than 60 percent of the area of the primary surface of the impeller blade, wherein said top and bottom exterior edges are the same size, and wherein said impeller efficiently mixes said gas or mixture of gases into said liquid; wherein the opening extends for a length which is from 20 to 70 percent of the length of the blade and for a width which is from 30 to 80 percent of the width of the blade; and wherein the impeller has a blade length in the range of 1 to 5 cm and a blade width of 0.5 to 2 cm and a thickness of 0.5 to 2 mm.

2. The impeller of claim 1, wherein the length of the opening extends 25-60% of the length of the blade.

3. The impeller of claim 1, wherein the length of the opening extends 30-55% of the length of the blade.

4. The impeller of claim 1, wherein the width of the opening extends 50-75% of the width of the blade.

5. The impeller of claim 1, where the length is about 2.5 to 3.5 cm and the width is about 1 to 1.5 cm and the thickness is about 0.7 to 1.5 mm.

6. The impeller of claim 1, wherein a portion of the blade from the bottom interior edge to the bottom edge comprises about 15 to 50% of the length of the blade and a portion of the blade from the top interior edge to the top edge comprises 10% to 40% of the length of the blade.

7. The impeller of claim 1, wherein the blade comprises a material selected from metal, ceramic, or filled or unfilled polymer.

8. The impeller of claim 1, wherein said blade and support are integral with each other and are molded as a single piece.

9. The impeller of claim 1, wherein the support comprises a coupling element for releasably coupling said support to a drive mechanism for rotating the impeller.

10. An apparatus for mixing a gas or mixture of gases into a liquid, the apparatus comprising a mixing container having a closed bottom and a side wall extending from the closed bottom defining a capacity of less than about 50 milliliters, the impeller of claim 1 extending into the container but not in contact with the bottom or side wall of the container, and a driver in contact with the top portion of the support to cause rotation of the impeller around its longitudinal axis, wherein the impeller efficiently mixes a gas or mixture of gases into a liquid.

11. The apparatus of claim 10 wherein the width of the blade is less than the inside diameter of the container and the length of the blade is less than the height of the container.

12. The apparatus of claim 10, wherein the side wall defines a container with a cylindrical shape.

13. The apparatus of claim 10, wherein the width of the blade is at least 50% of the distance defined by the side wall of the container.

14. The apparatus of claim 13 wherein the width of the blade is 60-95% of the distance defined by the side wall of the container.

15. The apparatus of claim 10, where the capacity is less than 20 mL.

16. The apparatus of claim 10, wherein the ratio of height of the side walls to maximum distance from side wall to side wall is less than 5.

17. The apparatus of any of claim 12, wherein the axis of the cylindrical container is the same as the longitudinal axis of the impeller.

18. The apparatus of claim 10, wherein the top portion of the impeller support is configured for releasable engagement with a coupling device of the driver.

19. The apparatus of claim 10, wherein the container and impeller are located in a chamber which is closed and comprises at least one port for addition of materials to the container.

* * * * *